United States Patent [19]

Hyams

[11] 4,301,991

[45] Nov. 24, 1981

[54] INGOT MOLD ASSEMBLY

[75] Inventor: William M. Hyams, Beaver, Pa.

[73] Assignee: Crucible Inc., Pittsburgh, Pa.

[21] Appl. No.: 72,964

[22] Filed: Sep. 6, 1979

[51] Int. Cl.[3] ..... B22D 7/06

[52] U.S. Cl. ..... 249/174; 249/204

[58] Field of Search ..... 249/174, 204, 206, 135; 220/241, 242, 352, 354

[56] References Cited

U.S. PATENT DOCUMENTS

| | | | |
|---|---|---|---|
| 2,280,906 | 4/1942 | Felsing | 249/204 |
| 3,995,677 | 12/1976 | Campbell | 249/204 X |
| 4,097,019 | 6/1978 | Conners | 249/204 |
| 4,120,345 | 10/1978 | Strange et al. | 249/174 X |

FOREIGN PATENT DOCUMENTS

| | | | |
|---|---|---|---|
| 6907300 | 3/1969 | Netherlands | 249/174 |
| 280658 | 11/1927 | United Kingdom | 220/352 |

*Primary Examiner*—Robert D. Baldwin

*Attorney, Agent, or Firm*—Clair X. Mullen, Jr.

[57] ABSTRACT

A vertical, open-ended ingot mold assembly including a mold stool having a relieved portion machined in its base which machined relieved portion has a cavity therein produced by erosion during casting. The useful life of the mold stool is prolonged by providing a quantity of metal particles to fill the cavity and having a plate positioned over the cavity and metal particles, which plate is secured within the cavity by a ring that is within the relieved portion of the mold stool. This ring protects the periphery of the machined relieved portion from erosion during casting and also prevents the plate and metal particles from mingling with the cast metal. For each successive casting operation, the eroded cavity is filled with metal particles and a new plate is positioned thereover. Alternately, the use of metal particles may be avoided by using only a plate of a thickness sufficient to protect the remainder of the mold stool from erosion.

9 Claims, 5 Drawing Figures

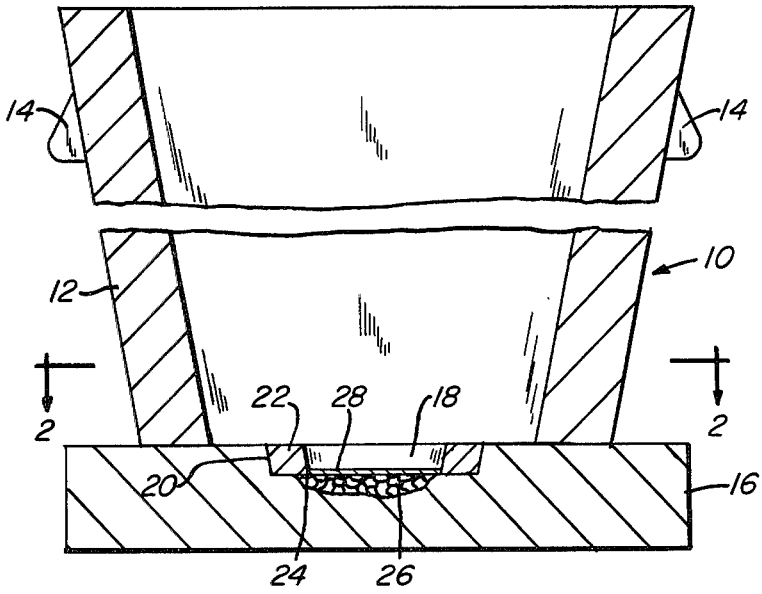
FIG. 1
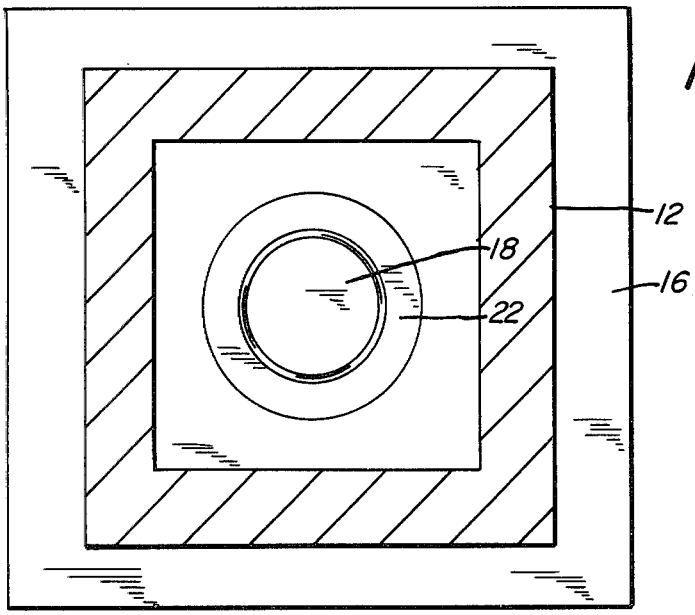
FIG. 2
FIG. 3
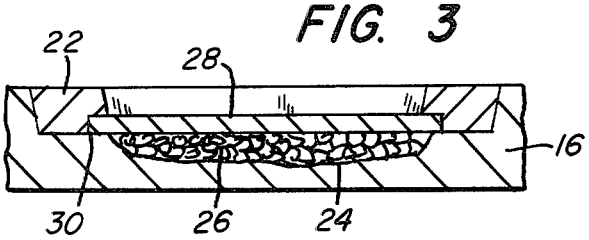
FIG. 4
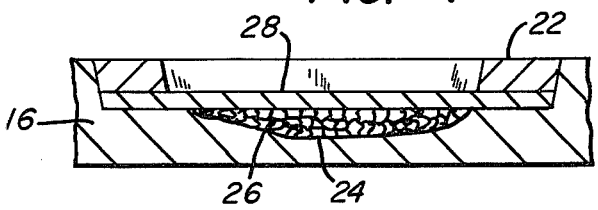

INGOT MOLD ASSEMBLY

In the production of alloy ingots, it is known to teem molten metal from a transport ladle into a plurality of open-ended molds that are removably positioned on mold stools, with the mold stool acting as the bottom or base of the mold. Upon solidification of the cast metal, which typically is in the form of ingot casting, either the ingot or mold is removed from the mold stool; typically the mold or casting is lifted vertically from the mold stool as by the use of an overhead crane. The ingot casting is then further processed as by conventional forging or rolling techniques.

During the casting operation the stream of molten metal from the transport ladle in accordance with conventional practice initially strikes the mold stool constituting the bottom surface of the mold and creates a cavity by erosion on the mold stool surface. As a result of this erosion, mold stools must either be frequently replaced or reconditioned. Otherwise, if the erosion-caused cavity is not repaired as it grows larger it fills with molten metal during the casting operation and not only reduces product yield but may necessitate an operation to remove the resulting protrusion prior to the ingot casting being processed further in the conventional manner by forging or rolling.

It is accordingly a primary object of the present invention to provide an ingot mold assembly for ingot casting operations which permits the erosion cavity formed in the mold stool to be efficiently repaired after each casting operation, thereby increasing product yield and adding significantly to the life of the mold stool.

Another more specific object of the invention is to provide an ingot mold assembly wherein the mold stool can be repaired by filling the erosion-caused cavity therein with metal particles covered with a metal plate, while preventing the plate and/or the metal particles from comingling with the cast metal in the mold, which prevents contamination of the metal being cast.

An additional more specific object of the invention is to provide an ingot mold assembly wherein the mold stool has a cavity with a metal plate therein at the area of erosion, so that erosion occurs on the plate surface; the plate is periodically replaced.

These and other objects of the invention, as well as a more complete understanding thereof, may be obtained from the following description and drawings, in which:

FIG. 1 is a schematic showing of an open-ended ingot mold and mold stool constructed in accordance with one embodiment of the present invention;

FIG. 2 is a view in horizontal section taken along lines II—II of FIG. 1; and FIGS. 3, 4 and 5 are schematic showings of three additional specific embodiments of the invention.

Figure 5:
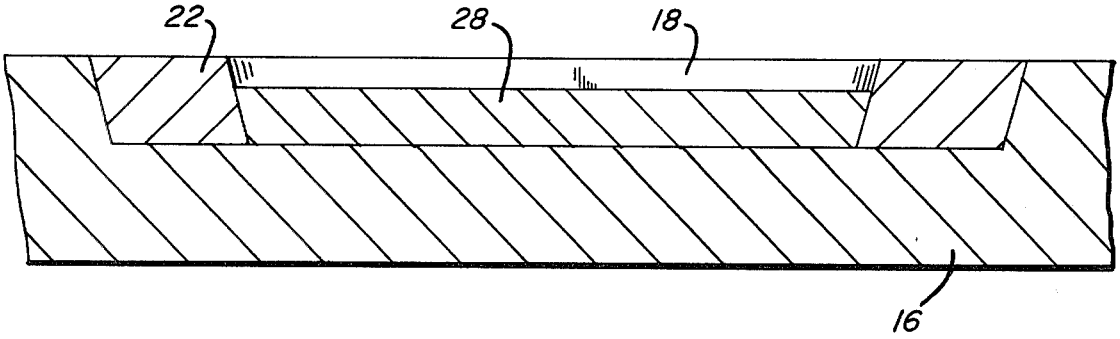

Broadly in accordance with the practice of the invention, an open-ended ingot mold assembly is provided wherein the conventional mold stool is modified by having on the surface thereof enclosed by the ingot mold a relieved portion which is preferably circular. The relieved portion may be formed in the mold stool surface by casting, machining or a combination of both. During the teeming operation the molten metal strikes within the relieved portion of the mold stool to create by erosion a cavity therein. It is, of course, this erosion-caused cavity which necessitates with conventional practice continued, expensive repair of mold stools. In accordance with the preferred practice of the present invention prior to each casting operation the erosion-caused cavity is filled with metal particles, and the cavity and metal particles are covered with a steel plate. Means, which preferably constitutes a ring, are provided to secure the plate atop the cavity sufficient to prevent it from becoming dislodged during the teeming operation. Specifically, during teeming the mechanical action of the molten metal stream striking the plate may cause it to move to result in metal particles from the cavity mingling with the molten metal. In addition, because of the buoyancy effect caused by the molten metal, the plate if not secured tends to float upwardly into the molten metal being cast. This likewise permits movement of the metal particles from the cavity into the metal. In any of these instances the metal of the plate and/or the metal particles mingle with the casting metal and to a degree melts to alter the metallurgical composition of the cast metal. By altering the metallurgical composition this may of course alter the properties of the casting and render it unsatisfactory for its intended application. The ring should abut the sides or periphery of the relieved portion in the mold stool to prevent any erosion thereof. In this manner redressing of the relieved portion caused by erosion during casting is minimized if not completely eliminated. When the ring has been eroded to an extent sufficient to render it ineffective for securing the plate it may be replaced with a new ring and if the dimensions of the relieved portion have not been altered by erosion the rings may be produced to a standard dimension. To further facilitate protection of the periphery of the relieved portion in the mold stool a refractory sealant material, which may be a refractory clay or flexible metallic material, may be placed between the outside of the ring and the periphery of the relieved portion to insure that no molten metal during casting seeps into the separation between the outside of the ring and the periphery of the relieved portion. Likewise, if desired, to insure that the plate remains in place during the casting operation its diameter may be made to correspond substantially to the inside diameter of the ring so that the plate is held in place by the friction between it and the ring. In addition, wedges may be driven between the plate and the ring to further secure the plate. Alternately, the base of the ring may be notched so that the plate fits into the notched portion of the ring overlying the plate. Another embodiment would involve the ring overlying a portion of the outer edge of the plate. An additional embodiment would involve the use of a plate.

With reference to the drawings, and for the present to FIGS. 1 and 2 thereof, there is shown an assembly 10, which includes a vertical open-ended ingot mold 12 having side lugs 14 to facilitate removal and transport, as by the use of an overhead crane. The mold 12 is positioned on a mold stool 16, which mold stool has a circular relieved portion 18 machined on its surface. The relieved portion 18 is circular and concentric with the portion of the mold stool enclosed by the mold. The periphery of the relieved portion 18, indicated by the numeral 20, is beveled. The beveled portion 20 facilitates engagement of a steel ring 22. A cavity 24 caused by erosion during teeming of molten metal into the mold is formed within the relieved portion. Prior to each casting operation the cavity 24 is filled with metal particles 26, which may be in the form of steel shot and the cavity and metal particles are covered with a steel plate 28. The steel plate 28 has a diameter corresponding substantially to the inside diameter of the ring 22 so that when the ring 22 and plate 28 are in position as shown in FIGS. 1 and 2 the friction between the periphery of the plate 28 and the inside of the ring holds the plate securely in place. As mentioned hereinabove, this is to prevent the plate from becoming dislodged during the casting operation. To further facilitate positive securing of the plate over the cavity, wedges may be driven between the periphery of the plate and the inside of the ring. Likewise, to prevent molten metal from entering between the outside of the ring and the periphery of the cavity a sealing material, such as refractory clay or flexible metallic material, may be placed between the ring and the periphery of the relieved portion 18. The inside of the ring is beveled to further facilitate wedging of the steel plate 28 within the ring, thereby increasing the friction between the ring and the plate to insure that the plate is positively secured.

After each casting operation, and removal of the mold and ingot from the mold stool, the steel plate will generally adhere to the bottom of the casting and be removed therewith. Any portion of the metal particles likewise removed are replaced and a new plate positioned as described hereinabove and shown in FIGS. 1 and 2. The mold stool is then ready for the next casting operation.

With reference to FIG. 3 of the drawings the ring 22 is shown having a notch formed along its interior bottom edge, indicated as 30, and the steel plate 28 fits into the notch. This eliminates the need for wedges and more positively secures the plate without relying solely on the friction created between the ring and the plate.

With reference to FIG. 4 the ring is shown overlying a marginal portion of the plate 28, thereby positively securing it over the cavity 24.

With reference to FIG. 5 an alternate embodiment of the invention is shown wherein no metal particles are employed. Instead, plate 28 has a thickness, sufficient that when erosion occurs during teeming the resulting erosion-caused cavity is formed entirely in the plate without affecting the mold stool 16. The maximum thickness of plate 28 is equal to the depth of the relieved portion 18. The plate is periodically replaced, and replacement generally is required after each teeming operation.

I claim:

1. An ingot mold assembly for ingot casting including a vertical, open-ended mold removably positioned on a mold stool to enclose a surface area thereof, said mold stool having on said enclosed surface area a relieved portion, said relieved portion having a base with a cavity therein produced by erosion during casting, a quantity of metal particles essentially filling said cavity, a plate positioned within said relieved portion and covering said cavity and metal particles, and means within said relieved portion for securing said plate and for protecting the periphery of said relieved portion from erosion during casting, whereby during casting the plate and metal particles are secured in place and do not mingle with molten metal being cast and the periphery of the relieved portion is protected from erosion.

2. An ingot mold assembly for ingot casting including a vertical, open-ended mold removably positioned on a mold stool to enclose a surface area thereof, said mold stool having on said enclosed surface area a circular relieved portion, said circular relieved portion having a base with a cavity therein produced by erosion during casting, a quantity of metal particles essentially filling said cavity, a plate positioned within said circular relieved portion and covering said cavity and metal particles, and a ring positioned within said circular relieved portion and securing said plate, whereby during casting the plate and metal particles are secured in place and do not mingle with molten metal being cast and the periphery of the relieved portion is protected from erosion.

3. The assembly of claim 2 wherein the outside diameter of said ring conforms substantially with the diameter of said relieved portion.

4. The assembly of claim 3 wherein said plate is circular with a diameter conforming substantially to the inside diameter of said ring and is thereby secured by friction with said ring.

5. The assembly of claim 3 wherein a refractory sealing material is placed between said ring and the periphery of said relieved portion.

6. The assembly of claim 4 wherein wedges are placed between said plate and said ring.

7. The assembly of claim 3 wherein said ring is placed atop and in overlapping engagement with said plate.

8. The assembly of claim 3 wherein said ring has a notched portion adjacent said base of said relieved portion and said notched portion engages said plate.

9. The assembly of claim 2 wherein said relieved portion of said mold stool has a periphery that is beveled toward the axis of said relieved portion and said ring has a mating outside surface.

* * * * *